United States Patent [19]

Tomura et al.

[11] 4,121,888

[45] Oct. 24, 1978

[54] TONER IMAGE-FIXING DEVICE

[75] Inventors: Kouichi Tomura; Hiroshi Maekawa, both of Amagasaki, Japan

[73] Assignee: Mitsubishi Denki Kabushiki Kaisha, Tokyo, Japan

[21] Appl. No.: 811,981

[22] Filed: Jun. 28, 1977

[30] Foreign Application Priority Data

| | | | |
|---|---|---|---|
| Jun. 29, 1976 | [JP] | Japan | 51-77477 |
| Jul. 19, 1976 | [JP] | Japan | 51-86208 |
| Jul. 21, 1976 | [JP] | Japan | 51-87577 |

[51] Int. Cl.[2] ..... G03G 15/00

[52] U.S. Cl. ..... 355/14; 219/216; 355/3 FU

[58] Field of Search ..... 355/14, 3 FU; 219/216, 219/388 W

[56] References Cited

U.S. PATENT DOCUMENTS

| | | | |
|---|---|---|---|
| B 345,384 | 1/1975 | Hutner | 219/216 |
| 3,187,162 | 6/1965 | Hojo et al. | 355/3 FU |
| 3,445,626 | 5/1969 | Michaels | 355/3 FU |

*Primary Examiner*—Richard L. Moses

[57] ABSTRACT

An record medium bearing toner images is intermittently moved at different speeds toward a fixing unit including a flash lamp. Each time one portion of the record medium occupies the effective fixing section of its run for the lamp as determined by a sensor device, the flash lamp is lighted to fix the toner images on that portion of the record medium. This fixing is repeated with the succeeding portions of the record medium until all the toner images on the record medium are successively and continuously fixed.

8 Claims, 7 Drawing Figures

TONER IMAGE-FIXING DEVICE

BACKGROUND OF THE INVENTION

This invention relates to a high speed facsimile transmission system and more particularly to a toner image-fixing device used with such a system to fix unfixed toner images on a record medium.

Conventional facsimile transmission systems consume the time period of from 4 to 6 minutes for transmitting, a manuscript prepared on a piece of paper having a size of A4 (210mm × 297mm) according to Japanese Industrial Standards (JIS) through a telephone line. In order to economically utilize the telephone line, high speed facsimile transmission systems for decreasing the transmission time have been required and particular in long distance transmission. In order that a manuscript such as above described can be transmitted within a time period on the order of one minute through a telephone line, the existing facsimile transmission systems include the band compressor to be adapted to read and write that portion of the manuscript having a high information density at a low speed while reading and writing that portion thereof having a low information density and a blank portion thereof at a high speed. On the receiver side, therefore, electrostatic latent images are formed on a record medium fed intermittently and at different speeds as determined by a band compressed signal from an associated transmitter. For example, the record medium may have a feed speed variable from 0.1 to 70 millimeters per second. That is, the feed speed has a maximum magnitude equal to seven hundred times its minimum magnitude. Thus it has been difficult to completely fix developed toner images on a record medium having such a large change in feed speed.

Conventional fixing devices involve the open type, the hot plate type the type utilizing a flash lamp etc. When used in fixing toner images on a record medium intermittently fed at different speeds as above described, those devices have been dis advantageous in the following respects: In the open type devices for melting and fixing the toner images in an atmosphere of heated air, the record medium being suspended or fed at an extremely low speed may contact heat too much to be yellowed or scorched. On the contrary, the feed at a high speed may cause a phenomenon that the toner image is not yet fixed. The hot plate type devices are good in thermal efficiency as compared with the open type devices, but when the record medium cut into predetermined sizes is used with such devices, the end portions of cut medium are apt to be put in poor contact with the hot plate with the result that toner images on the end portions thereof poorly contacted by the hot plate remain unfixed. In addition, waiting time is required until the devices exhibit the desired fixing ability and therefore they must remain heated. Thus the temperature within the devices is raised leading to a fear that the particular circuit components and the characteristics of a toner used are deteriorated. Finally, in flush lamp type, the fixing operation is performed without any delay time but in view of repeated lighting times, the optical output has been required to be relatively high in order to effect always the complate fixing.

In conventional high speed facsimile transmission systems there has not yet provided suitable fixing means for continuously fixing toner images on the record medium fed intermittently and still at different speeds. This has resulted in the necessity of performing the two stage operation in which the record medium bearing electrostatic latent images thereon is temporally stocked without passing through the fixing device until the latent images have been completed to be formed on the record medium after which the latent images are developed and fixed at a predetermined constant speed on the record medium. This measure has required additional means for holding the record medium until the formation of electrostatic latent images is completed, feeding the record medium to developing and fixing devices after the formation of the latent images have been completed and controlling the holding and feeding means and developing and fixing devices. Therefore the resulting system has been inevitably large-sized and expensive.

Accordingly it is an object of the present invention to provide in a facsimile receiver for forming electrostatic latent images intermittently and at different speeds in response to a band compressed signal transmitted thereto, a new and improved toner image-fixing device for successively and continuously fixing toner images, developed with a magnetic toner on a record medium having the electrostatic latent images formed thereon and fed at said different speeds.

It is another object of the present invention to provide a new and improved toner image-fixing device including a source of flash light, for fixing toner image on each portion of a record medium having a predetermined length at a time thereby to successively and continuously fix all the toner images on the record medium.

It is still another object of the present invention to provide a new and improved toner image-fixing device including a plurality of a hog plates disposed along a run of a record medium to preliminarily heat toner images on the record medium being fed.

SUMMARY OF THE INVENTION

The present invention provides a fixing device for fixing toner image on a record medium, comprising feed means for intermittently moving a record medium bearing toner images at different speeds along a run thereof, a fixing unit including a source of flash light for fixing the toner images on the record medium over a predetermined effective fixing section of the run, a sensor unit for sensing the movement of the record medium equal in distance to the effective fixing section within said section to produce a sensed signal, and a control circuit responsive to the sensed signal to control the lighting of the source of flash light thereby to successively and continuously fix the toner images on said record medium in such a manner that the toner images on each portion of the record medium equal in length to the effective fixing section are fixed at a time.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
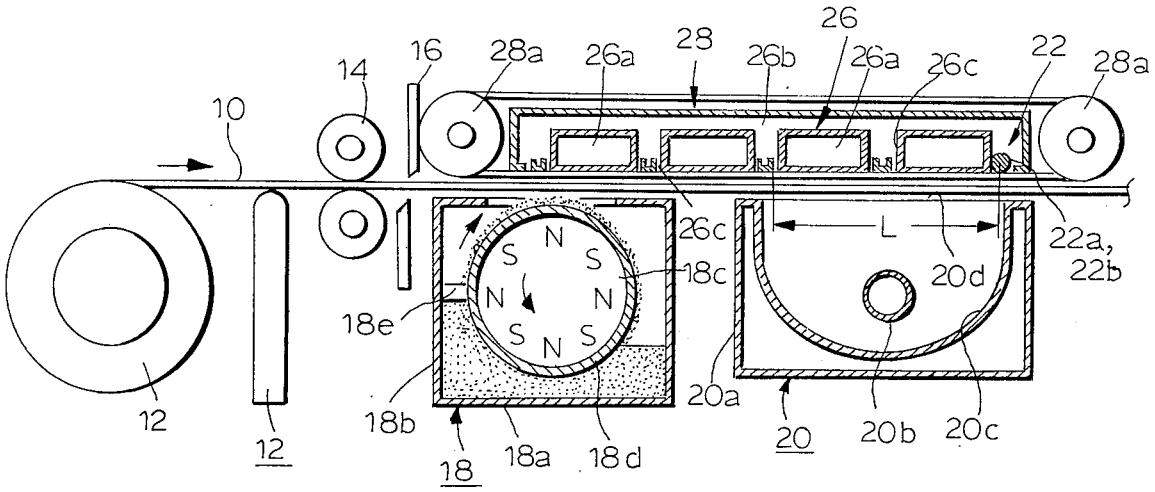
FIG. 1 is a schematic elevational view, partly in longitudinal section, of a toner image-fixing device constructed in accordance with the principles of the present invention.

Referring now to FIG. 1 of the drawings, there is illustrated a toner image-fixing device constructed in accordance with the principles of the present invention. The arrangement illustrated comprises a record medium 10 in the form of a tape from a supply roll 12 travels past an image forming unit 14 which is schematically shown by block 14 to enter a nip between a pair of feed rolls through the rotation thereof. The image forming unit 12 may be an electrostatic recorder device of the well known construction having a multiplicity of pointed electrodes aligned in the cross direction and opposing to a flat electrode to successively form electrostatic latent images on the record medium as passing therebetween through the selective discharge across the electrodes in response to a receive facsimile signal. The feed rolls 14 are driven by a pulse motor under the control of received compressed signal to intermittently feed the record medium 10 at different speeds. The term "band compressed signal" refers to a speed control signal for changing a reading or writing speed in accordance with an information density of a manuscript to be facsimiled. More specifically, upon reading the particular manuscript, the band compressed signal is operated to increase the reading speed on that portion of the manuscript having a high information density while decreasing the reading speed on that portion thereof having a low information density.

The record medium 10 bearing the electrostatic latent images thus formed passes through a cutter unit 16 as will be described hereinafter and thence through a developing and a fixing unit generally designated by the reference numerals 18 and 20 respectively and disposed along a run of the record medium intermittently and still at different speeds by means of the feed rolls 14. Thereafter the record medium bearing the fixed toner images taken out from the fixing device through the fixing unit 20.

The developing unit 18 is operative 18 develop the electrostatic latent images on the record medium 10 as passed therethrough a magnetic toner powder **18*a* charged in a toner container 18*b* disposed below the run of the record medium 10. Within the toner container 18*n* a rotary cylindrical magnet 18*c* is also disposed in the cross direction to be rotated at a predetermined constant speed of rotation and includes an outer periphery magnetically charged so that a plurality of magnetic N poles alternate magnetic S poles. A stationary sleeve 18*d* of non-magnetic metal is loosely fitted onto the cylindrical magnet 18*c* to be coaxial therewith to cause the uppermost portion thereof to substantially contact the run of the record medium 10. Further a control plate 18*e* coextensive with the sleeve 18*d* is disposed within the toner container 18*b* on the lefthand side as viewed in FIG. 1 of the sleeve 18*d*** to leave a narrow gap therebetween to maintain a predetermined constant thickness of the toner powder in a layer moved along the periphery of the sleeve as will be described later.

As the cylindrical magnet **18*c* is rotated in the direction of the arrow shown in FIG. 1 or the counter clockwise direction as viewed in FIG. 1, the magnetic toner powder 18*a* within the toner container 18*b* is moved in the clockwise direction as shown at the other arrow in FIG. 1 and along the stationary sleeve 18*c*. Then it passes through the narrow gap between the control plate 18*e* and the sleeve 18*d* to ascends in a layer with a predetermined constant thickness along the exposed portion of the sleeve 18*d*. The toner powder 18*a* reaching the upper portion of the sleeve 18*d* successively develops the electrostatic latent images on the record medium 10 traveling just above the uppermost portion of the stationary sleeve 18*d***.

Then the record medium 10 bearing the toner images enters the fixing unit 20 shown in FIG. 1 as including a fixer **20*a*, a flush lamp 20*b* acting as a heat source disposed within the fixer 20*a* to extend in the cross direction and a reflector 20*c* located on that side of the flash lamp 20*b* remote from the run for the record medium 10. The reflector 20*c* is coextensive with the flash lamp 20*b* and has an opening 20*d* facing the run of the record medium 10. The reflector 20*c* serves to uniformly irradiate a section of the run as defined the opening 20*d* with light from the flash lamp 20*b* at a time, which lamp is preferably of the xenon type. That section has a length of L in the direction of travel of the record medium 10** and forms an effective fixing section.

If desired, the opening **20*d* of the reflector 20*c*** may have a length greater than the length L as above described.

When the record medium 10 bearing the toner images is moved past the opening **20*d* of the reflector 20*c* the toner images on the record medium 10 are fixed thereon through the lighting of the flash lamp 20*b*. In order to control the fixing operation or the lighting of the flash lamp 20*b*, there are provided a sensor unit and a lighting control circuit generally designated by the reference numerals 22 and 24** respectively.

As shown in FIG. 1, the sensor unit 22 includes a record medium sensor **22*a* located adjacent the outgoing end of the effective fixing section L to sense the presence of the record medium 10 at the outgoing end and a distance-of-movement sensor 22*b* for sensing a distance of movement of the record medium 10**.

Figure 2:
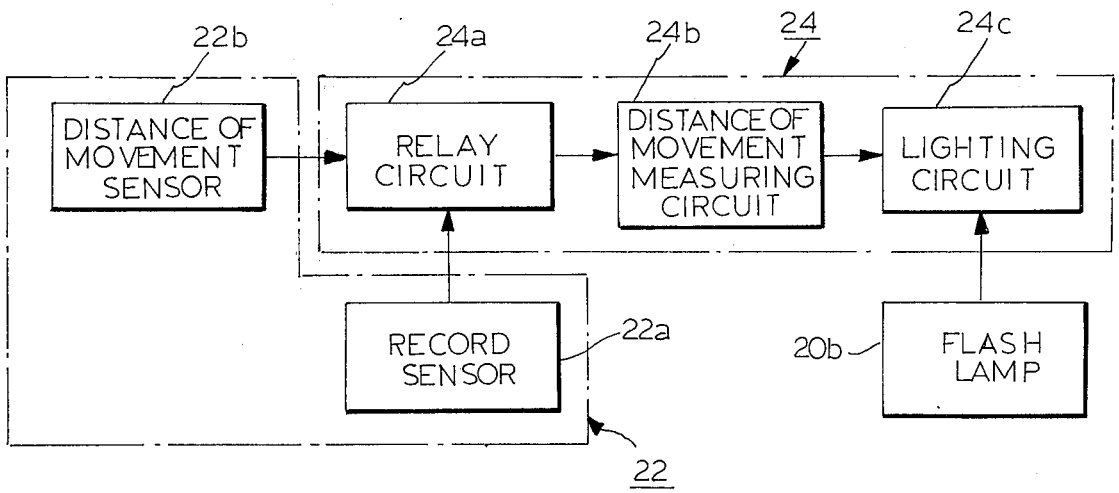
FIG. 2 is a block diagram of a control circuit for controlling the flash lamp shown in FIG. 1.

As shown in FIG. 2, the lighting control circuit 24 includes a relay circuit 24 having a pair of inputs connected to the record medium sensor **22*a* and a distance-of-movement sensor 22*b* respectively and an output connected to a distance-of-movement measuring circuit 24*b* subsequently connected to a lighting circuit 24*c* for lighting the flash lamp 20*b***.

In the presence of the record medium 10 as determined by the sensor **22*b*, the latter produces a presence signal which is, in turn applied to the relay circuit 24*a*. Also the distance-of-movement sensor 22*b* is responsive to the distance of movement of the record medium 10 to produce distance pulses one for each predetermined magnitude thereof. Those pulses are permitted to successively pars through the relay circuit 24*a* having the presence signal applied to thereto. Therefor the distance-movement measuring circuit 24*b* formed, for example, of a counter counts the distance pulses. When the count of the distance-of-movement measuring circuit 24*b* reaches a preliminarily magnitude corresponding to the length L of the effective fixing section as above described, the measuring circuit 24*b* produces a control signal and is cleared in readings for the next succeeding counting operation. This control signal is supplied to the lighting circuit 24c to light the flash lamp 20b**.

Thus when the record medium 10 enters the effective fixing section in the fixing unit 20 and then its leading end reaches the record medium sensor 20a is operated to light the flash lamp 20b thereby to fix the toner images on that portion of the record medium located over the effective fixing section of the run. Then, the distance-of-movement measuring circuit 24b counts the distances signal passed through the relay circuit 24a until the count thereof reaches the predetermined magnitude. Those distance signals results from the portion of the record medium 10 bearing the fixal toner images. At that time the circuit 24a produces the control signal resulting in the lighting of the flash lamp 20b.

Thus it is seen that the presence signal from the sensor 22a cooperates with the predetermined count of the circuit 24b caused from the just preceding passage of the record medium 10 through the effective fixing section to light the flash lamp 20b.

Thereafter the process as above described is repeated to successively and continuously fix the toner images on the record medium 10 in such a manner that the toner images on each portion of the record medium equal in length to the effective fixing section are fixed at a time.

In order to aid in moving the record medium 10 past the developing and fixing units 18 and 20 respectively along its run, a suction unit generally designated by the reference numeral 26 is disposed to birdge both units 18 and 20. The suction unit 26 includes a plurality, in this case, four of hollow slide plates 26a disposed in equally spaced relationship along and above the run of the record medium 10 and suction box 26b encircling the slide plates 26a and including suction ports 26c opening in the run between each pair of adjacent slide plates 26a, and a U-shaped strip interposed between that pair.

The interior of the suction box 26b reduces in pressure to perform the vacuum suction operation. Thus the record medium 10 being moved past the suction unit 26 is lightly attracted by the slide plates 26a by means of the air sucked into the suction box 26b. However the record medium 10 continues to follow its run without hindrance.

In order to making preparations for the fixing of toner images on a record medium cut into pieces, a conveyor unit generally designated by the reference numeral 28 is disposed above the run of the record medium 10 to extend from the incoming end of the developing unit 18 and the outgoing end of the fixing unit 20. In this case the cutter unit 14 is operated to cut the record medium 10 bearing the electrostatic latent images into predetermined lengths. The conveyer unit 28 includes a pair of conveyer rolls 28a one of which is disposed between the cutter unit 14 and the adjacent side of the suction box 26b to substantially contact the run of the record medium 10 and the other of which is located on the side of the suction box 26b adjacent to the outgoing end of the fixing unit 20 to substantially contact the run. Then an endless perforated conveyer belt 28b is spanned between the rolls 28a while impeding the attraction of the record medium 10 by the slide plates 26a. The belts 28b includes a lower run coinciding with the run of the record medium 10. One of the conveyer rolls 28a is adapted to be rotated at a predetermined constant speed by any suitable means (not shown) and therefore the lower portion of the endless conveyer belt 28b is moved at a predetermined constant speed in the same direction as the record medium 10. The speed at which the conveyer belt 28b carries the pieces of the record medium 10 is generally preselected to be somewhat higher than a maximum speed of the record medium 10 resulting from the feed rolls 4.

It will readily be understood that pieces of the record medium 10 are successively attracted by the slide plates 26a and successively carried by the lower portion of the conveyer belt 28b moved at the constant speed to enter the developing unit 18 where the electrostatic latent images on the pieces of the record medium 10 are successively developed with the toner powder. Thereafter the toner images are fixed in the manner as above described by the fixing unit 20.

From the foregoing it is seen that the arrangement of FIG. 1 is operative in eigher of the two modes one of which effects the movement of the continuous record medium 10 by the feed rolls 14 and the other of which effects the movement of the record medium 10 after having been cut into pieces by the conveyer unit 28. The continuous record medium 10 travels along the run without the effect of the moving conveyer belt 28b exerted thereon. In either of the modes of operation the suction unit 26 causes the record medium 10 to be lightly attracted by the slide plates 26a without impeding the movement of the record medium 10 thereby to aid in properly moving the record medium 10 along the run. In the movement of the pieces of the record medium 10 the suction unit 28 ensures that the each piece of the record medium 10 has its leading and tailing end portions attracted by the adjacent one or ones of the slide plates 28a.

Figure 3:
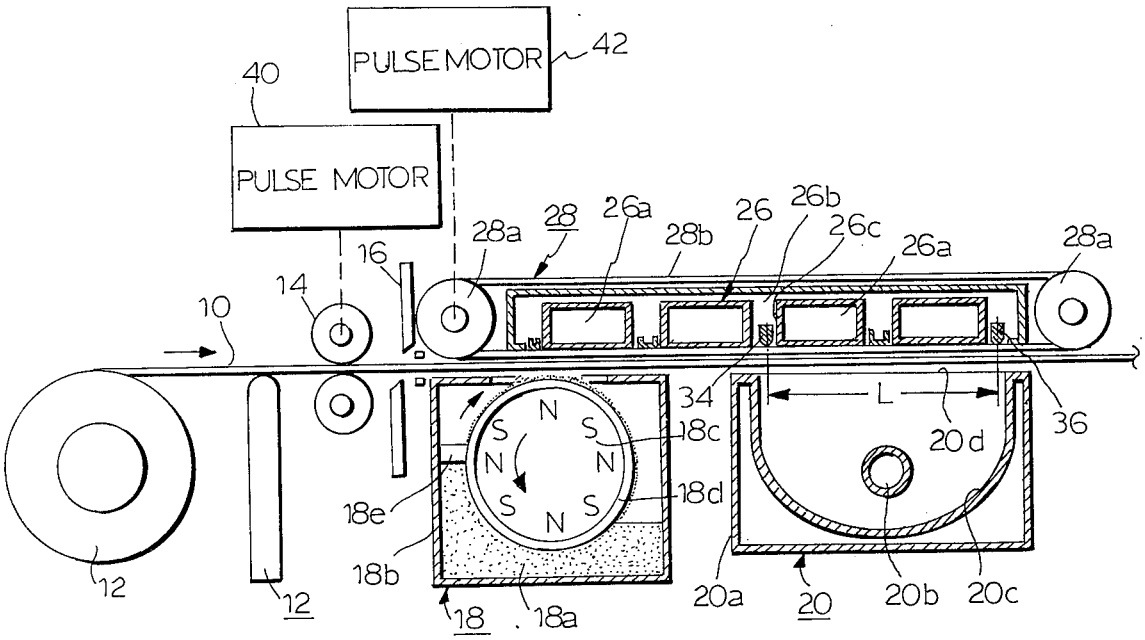
FIG. 3 is a view similar to FIG. 1 but illustrating a modification of the present invention.
Figure 4:
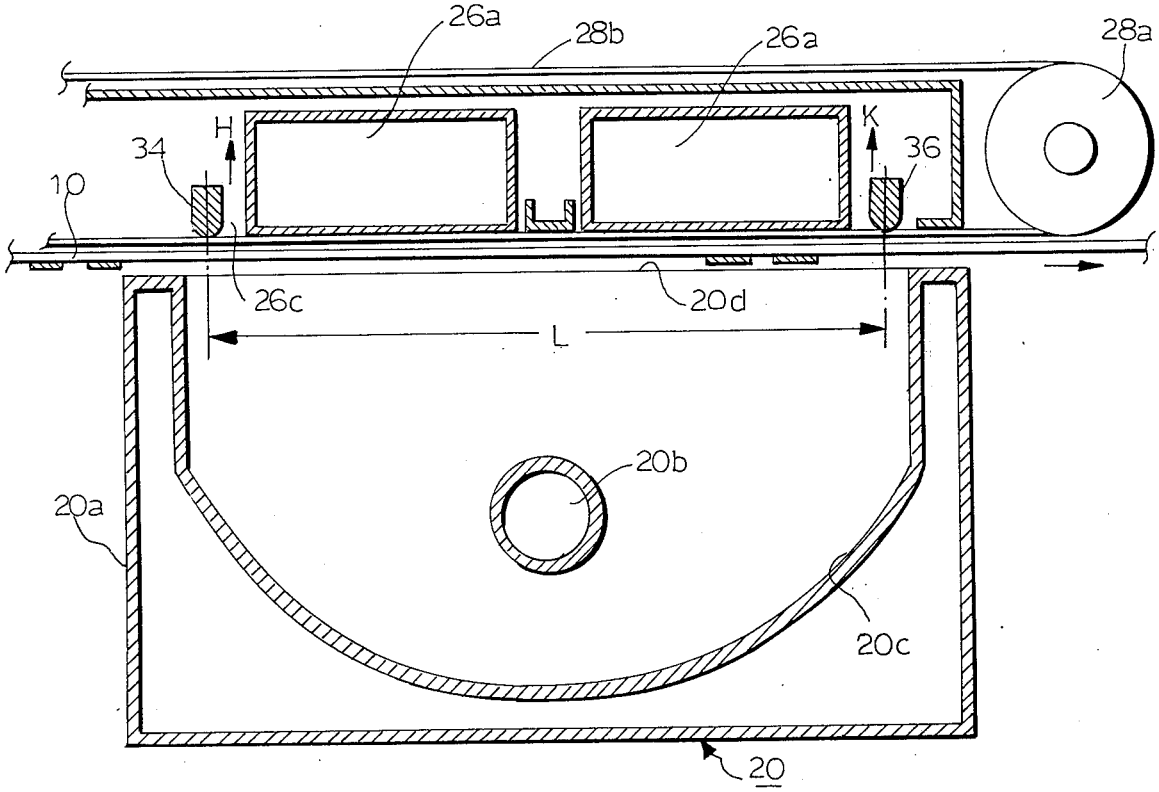
FIG. 4 is an enlarged longitudinal sectional view of one portion of the arrangement shown in FIG. 3.

The arrangement illustrated in FIG. 3 is different from that shown in FIG. 1 only in that in FIG. 3 a sensor sour-e of light 30 and an optical sensor 32 are disposed in opposite relationship on the rear side of the cutter unit 16 as viewed in the direction of travel of the record medium 10 to put the run of the record medium 10 therebetween while a pair of record medium sensors 34 and 36 disposed at the incoming and outgoing ends of the effective fixing section respectively as best shown in FIG. 4 with the sensor unit 22 omitted. In FIG. 4 the sensors 34 and 36 are shown as being raised in the directions of the arrows H and K respectively. More specifically, the sensor 34 is raised in the direction of the arrow H shown in FIG. 4 in response to the leading end of the record medium 10 entering the incoming end of the section L to deliver an output signal indicating that the record medium 10 is present at the incoming end of the section. Similarly the sensor 36 is raised in the direction of the arrow K shown in FIG. 4 in response to the leading medium end entering the outgoing end of the section L to deliver an output signal indicating that the record medium 10 is present at the outgoing end of the section L.

As in the arrangement of FIG. 1, the first speed at which the feed rolls 14 feeds the record medium 10 toward the outgoing end of the fixing unit 20 is rarely synchronized with the second speed at which the conveyer rolls 28a feed the record medium 10 toward the outgoing end thereof through the conveyer belt 28b. The second speed is generally maintained constant and somewhat higher than the first speed. Thus both speeds are not synchronized with each other which is the general case.

The operation of the arrangement shown in FIGS. 3 and 4 will now be described in conjunction with the feed speed of the record medium on the image forming unit 14 is synchronization with that due to the conveyer unit 28 and with reference to FIGS. 3 through 5.

Figure 5:
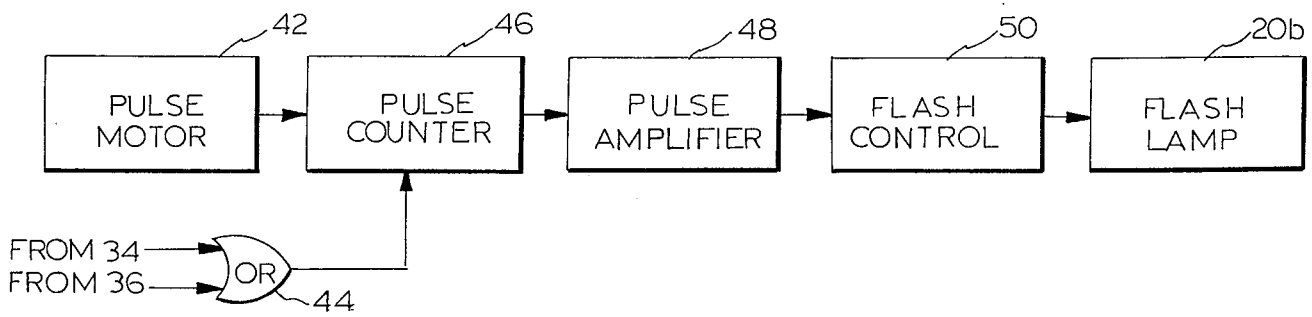
FIG. 5 is a block diagram of a control circuit for controlling the flash lamp shown in FIGS. 3 and 4.

FIG. 5 shows a control circuit for controlling the flash lamp 20*b* when both feed signals as above described is in synchronization with each other. Pulse motors 40 and 42 shown in FIG. 3 is successively applied with pulses for feeding the record medium and drives the feed and conveyer rolls 14 and 28*a* respectively in response to those feed pulses. Therefore the feed and conveyer rolls 16 and 28*a* respectively respond to the feed pulses to feed the record medium 10 intermittently and at different speeds. That is, the record medium 10 is developed intermittently and at the different speeds after which the developed record medium 10 reaches the incoming end of the effective fixing section in the fixing unit 20.

At that time, the record medium 10 raises the sensor 34 in the direction of the arrow H shown in FIG. 4. Accordingly the output from the sensor 34 is applied to one input to an OR gate 44 and thence to a pulse counter 46 to enable it. This permits the counter 46 to be initiated to count the pulses from the pulse motor 42 driving the conveyer roll 28*a*. On the other hand, the record medium 10 fed intermittently and at the different speeds until its leading end reaches the outgoing end of the effective fixing section in the fixing unit 20. This causes the sensor 36 to be raised in the direction of the arrow H shown in FIG. 4. Then the output from the sensor 36 is supplied via the OR gate 44 to the pulse counter 46 while at the same time the pulse counter 46 has counted up the number of the pulses corresponding to the length L of the effective fixing section through which the record medium 10 has traveled. Simultaneously the counter 46 delivers an output to a pulse amplifier 48 while it is cleared. After having been amplified by the pulse amplifier 48, this output is applied to the flash-lamp control 50 to light the flash lamp 20*b* only once. This results in the fixing of the toner images on that portion of the record medium 10 having the length L measured from its leading end. Under these circumstance the sensor 36 is maintained in its raised position.

Thereafter the process as above described is repeated to successively light the flash lamp 20*b* once for each distance L of travel of the record medium 10. Finally the tailing end of the record medium 10 formed by the cutter unit 16 reaches the incoming end of the effective fixing section. Immediately after the tailing end has been moved past the sensor 34, a switch (not shown) disposed in the sensor 34 is put in its OFF state whereupon the flash lamp 20*b* is lightened once.

Alternatively, the pulses driving the conveyer roll 28*a* may continue to be similarly counted up to the predetermined magnitude. At that time, the flash lamp 20*b* is lightened once.

In this way, the entire length of the record medium 10 has been completed to be fixed.

The operation of the arrangement shown in FIGS. 3 and 4 will now be described in conjunction with the feed speed of the record medium in the latent image-fixing unit not synchronized with that resulting from the conveyor rolls 28*a* and with reference to FIGS. 3, 4 and 6. While, both feed speeds in this case are different from each other the number of pulses corresponding to the length L of the effective fixing section is counted up thereby to light the flash lamp.

Figure 6:
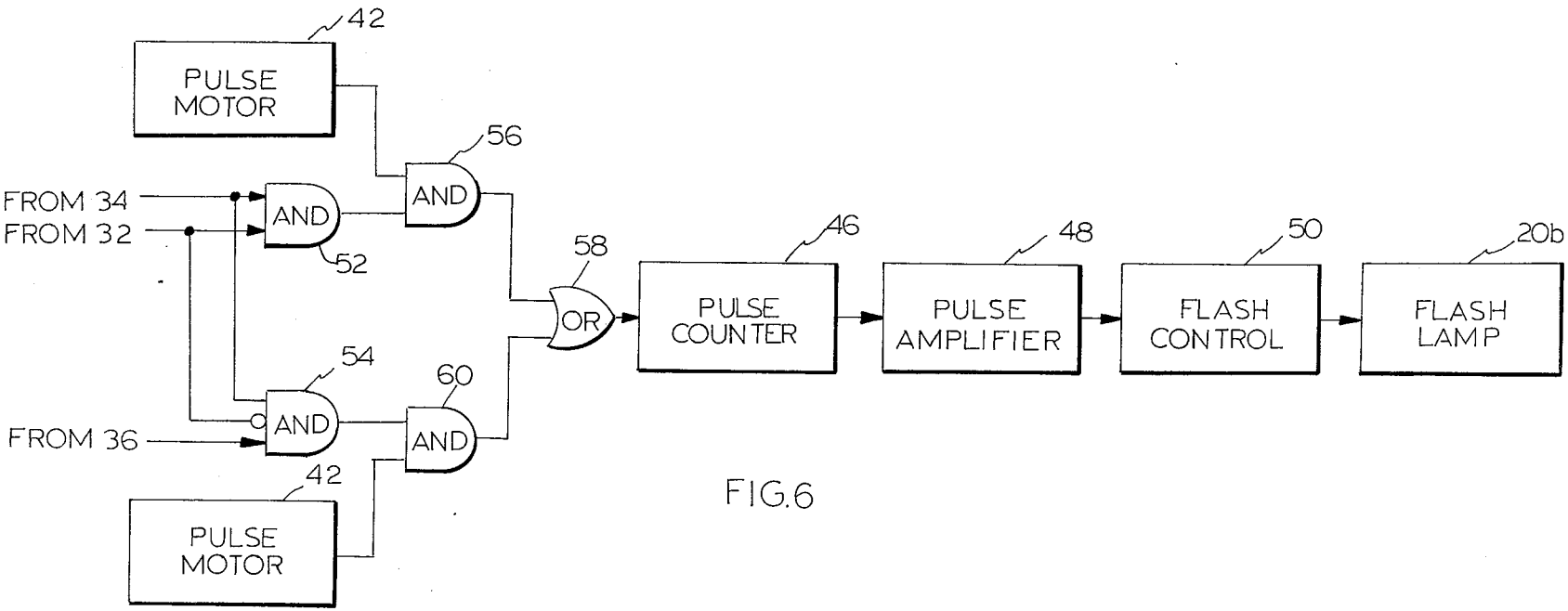
FIG. 6 is a block diagram of a modification of the control circuit shown in FIG. 5.

In FIG. 6 wherein like reference numerals designate the components identical to those shown in FIG. 5 there is illustrated a control circuit for the flash lamp different from that shown in FIG. 5 only in the selection of a pulse source from which pulses to be counted are produced. In general, pulses from the pulse motor 40 operatively coupled to the feed roll 14 are counted until the pieces of the record medium is carried by the conveyer belt 28*b* alone and after the record medium has been cut into pieces, pulses from the pulse motor 42 operatively coupled to the conveyer roll 28*a* is counted.

The optical sensor 32 continues to produce an output until the record medium is cut by the cutter unit 16. However it is to be understood that the optical sensor 32 provides no output before the record medium 10 enters the developing unit 18 which is out of the question. The output from the optical sensor 34 is applied to one input to an AND gate 52 and when the record medium 10 has its leading end entering the incoming end of the effective fixing section an output from the sensor 34 is applied to the other input to the AND gate 52 which, in turn, produces an output. The outputs from both sensors 32 and 34 are also to an AND gate 54 but the latter produces no putput because the output from the sensor 32 is inverted in polarity and then applied to the AND gate 54. The output from the AND gate 52 is applied to one input to another AND gate 56 to enable it. This permits a pulse motor 40 operatively coupled to the feed roll 14 to be connected to the pulse counter 46 through the AND gate 56 and an OR gate 58. That is, the pulses from the pulse motor 56 are counted up by the counter 46.

Then the record medium 10 has traveled the required distance and is cut by the cutter unit 16. This results in the sensor 32 providing no output. Thus the AND gate 52 is put in its disabled state to prevent the pulses from the pulse motor 40 from being counted by the counter 44. Instead the AND gate 54 is put in its enabled state. Under these circumstances, the sensor 36 normally produces an output which is, in turn applied to a third input to the AND gate 54. If the length of the record medium 10 is too short to produce an output from the sensor 36 then the output from the AND gate 54 may not be applied to the AND gate 60. In either case, the AND gate 54 produces an output. This output is applied to an AND gate 60 to put it in its enabled state to connect the pulse motor 42 operatively coupled to the conveyer roll 28*a* is connected to the counter 44 through the AND gate 60 and the OR gate 58. Accordingly the pulses from the pulse motor 42 is counted by the pulse counter 44.

In the arrangement of FIG. 6, therefore, it is seen that the flash lamp 20*b* is lighted in the same manner as above described in conjunction with FIGS. 3, 4 and 5.

Figure 7:
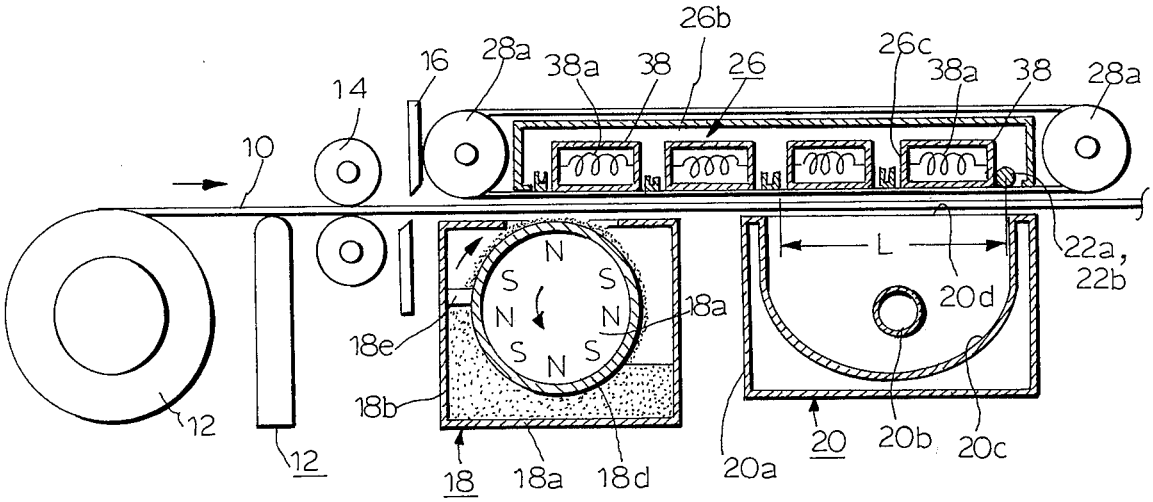
FIG. 7 is a view similar to FIG. 1 but illustrating another modification of the present invention.

Another modification of the present invention is illustrated in FIG. 7 wherein like reference numerals designate the components identical to those shown in FIG. 1. The arrangement of FIG. 7 is different from that shown in FIG. 1 only in that in FIG. 7 a plurality of hot plates 38 are substituted for the slide plate 26*a*. As shown in FIG. 7, the hot plate 38 is of the hollow type and has an electric heater 38*a* disposed therein and heated by any suitable electric source (not shown). That is the hot plate 38 is equivalent to the hollow slide plate 26*a* as shown in FIG. 1 provided in the interior with the electric heater 38*a* such as a coil of nichrom wire. As in the arrangement of FIG. 1, the record medium pushes against the hot plates 38 and is preliminarily heated. Then the toner image thus heated is fixed with light from the flash lamp 20*b* as previously described.

Therefore the arrangement is advantageous in that the optical output from the flash lamp can decrease because the toner images on the record medium are preliminarily heated by the hot plates. Thus the flash lamp can be increased in durability and repeatedly lighted at high speeds. Further since the preliminary heating is effected separately from the fixing, good hard copies are produced without the adverse effects such as yellowing exerted on the record medium.

In summary, the present invention includes a flash lamp performing the fixing operation in the effective fixing section throughout its length, so that the flash lamp is lighted once each time the record medium moves a distance corresponding to the effective fixing section therewithin. Therefore the toner images on the record medium are successively and continuously fixed so that the toner images on that portion of the record medium equal in length to the effective fixing section are fixed at a time. This successive, continuous fixing is effected regardless of the feed speed of the record medium and does not adversely affect the record medium itself. Also the flash lamp can be lighted at time intervals reasonably adjustable. Thus good hard copies are produced. Further suction unit disposed along the fun of the record medium makes it possible to properly feed the record medium along its run, and to establish the fixing conditions. In addition, the conveyer unit disposed separately from the suction unit permits the movement and fixing of pieces made by cutting the record medium. Further even though its feed speed would greatly change, the record medium can readily be fixed with the toner.

While the present invention has been illustrated and described in conjunction with a few preferred embodiments thereof it is to be understood that numerous changes and modifications may be resorted to without departing from the spirit and scope of the present invention. For example, the present invention is equally applicable to the fixing of toner images formed on a graphic plate and those transferred to transfer paper from the electro-photo graphic plate. The toner is not restricted to the magnetic type and may be of the type used in two system developing agents. Further the sensor unit and lighting control circuit described herein may be replaced by any well known means. In addition, the present invention is equally applicable to the fixing of toner images formed in general facsimile transmission.

Also the present invention has been illustrated and described in conjunction with the distance of travel of the record medium sensed by the mechanical and optical sensors and the pulse counting system but the same is not restricted thereby or thereto and may utilize any of methods of sensing the distance of travel.

What is claimed is:

1. A fixing device for fixing toner image on a record medium, comprising feed means for intermittently feeding a record medium bearing toner images at different speeds along a run thereof, a fixing unit including a source of flash light for fixing said toner images on said record medium over a predetermined effective fixing section of said run, a sensor unit for sensing the movement of said record medium equal in distance to said effective fixing section within said section to produce a sensed signal, and a control circuit responsive to said sensed signal to control the lighting of said source of flash light thereby to successively and continuously fix said toner images and said record medium in such a manner that the toner images on each portion of the record medium equal in length to said effective fixing section are fixed at a time.

2. A fixing device for fixing toner images on a record medium as claimed in claim 1 wherein said sensor unit includes a distance-of-travel sensor for producing distance signals at predetermined constant intervals, a record medium sensor for sensing said fixing unit being covered with said record medium to produce a presence signal, a relay circuit responsive to said presence signal to permit the passage of said distance signals therethrough, and a distance-of-movement measuring circuit for counting said distance signals passed through said relay circuit and producing a control signal when the count thereof reaches a predetermined magnitude, said control signal lighting said source of flash light.

3. A fixing device for fixing toner images on a record medium as claimed in claim 1 wherein said sensor unit includes means for taking out distance signals having predetermined constant intervals from said feed means, a record medium sensor for sensing said fixing unit being covered with said record medium to produce a presence signal, a relay circuit responsive to said presence signal to permit the passage of said distance signs therethrough, and a distance-of-movement measuring circuit for counting said distance signals passed through said relay circuit and producing a control signal when the count thereof reaches a predetermined magnitude, said control signal lighting said source of flash light.

4. A fixing device for fixing toner images on a record medium as claimed in claim 1 wherein a suction unit is disposed along a portion of said run including at least said effective fixing section to feed said record medium so as to correctly follow said run while said record medium is attracked thereby.

5. A fixing device for fixing toner images on a record medium as claimed in claim 1 wherein a cutter unit is disposed to cut said record medium into pieces and a conveyer unit is disposed along a portion of said run including at least said effective fixing section to convey said pieces of the record medium along said run.

6. A fixing device for fixing toner images on a record medium comprising feed means for intermittently feeding a record medium bearing toner images at different speeds along a run thereof, a fixing unit including a source of flash light for fixing said toner images on said record medium over a predetermined effective fixing section of said run, a first and a second record medium sensor disposed on an incoming and an outgoing side of said fixing unit to produce presence signal indicating that said record medium is present on said incoming and outgoing sides respectively, means for taking out distance signals having predetermined constant intervals from said feed means, a gate circuit responsive to said presence signals from said first and second record medium sensors to deliver said distance signals for a predetermined time interval, and a distance-of-movement measuring circuit for counting said distance signals delivered from said gate circuit and producing a control signal when the count thereof reaches a predetermined magnitude, said control signal lighting said source of flash light whereby said toner images on said record medium are successively and continuously fixed in such a manner that the toner images on each portion of said record medium equal in length to said effective fixing section are fixed at a time.

7. A fixing device for fixing toner images on a record medium comprising feed means for intermittently feeding a record medium bearing toner images at different speeds along a run thereof, cutter unit for cutting said record medium into pieces before the formation of said toner images on said record medium, a fixing unit including a source of flash light for fixing said toner images on said record medium over a predetermined effective fixing section of said run, a conveyer unit for successively conveying said pieces of said record medium toward said fixing unit, a first and a second record medium sensor disposed on an incoming and an outgoing side of said fixing unit to produce presence signals when said record medium is present on said incoming and outgoing sides respectively, a third record medium sensor for sensing the cutting of said record medium into said pieces to produce a piece signal, means for taking out distance signals from each of said feed means and said conveyer unit, a gate circuit responsive to the absence of said piece signal to deliver said distance signals from said feed means and responsive to the presence of said piece signal to deliver said distance signals from said conveyer unit, and a distance-to-movement measuring circuit for counting said distance signals delivered from said gate circuit and producing a control signal, when the count thereof reaches a predetermined magnitude, said control signal lighting said source of flash light whereby said toner images on said record medium are successively and continuously fixed in such a manner that the toner images on each portion of said record medium equal in length to said effective fixing section are fixed at a time.

8. A fixing device for fixing toner image on a record medium, comprising feed means for intermittently feeding a record medium bearing toner images at different speeds along a run thereof, a fixing unit including a source of flash light for fixing said toner images on said record medium over a predetermined effective fixing section of said run, a sensor unit for sensing the movement of said record medium equal in distance to said effective fixing section within said section to produce a sensed signal, a preliminarily heating unit disposed along a portion of said run including at least said effective fixing section to preliminarily heat said toner images on said record medium coming thereto, and a control circuit responsive to said sensed signal to control the lighting of said source of flash light thereby to successively and continuously fix said toner images on said record medium in such a manner that the toner images on each portion of said record medium equal in length to said effective fixing section are fixed at a time.

* * * * *